US007958944B2

(12) United States Patent
Lehnert et al.

(10) Patent No.: US 7,958,944 B2
(45) Date of Patent: Jun. 14, 2011

(54) DISCONTINUOUS DRIVE TOOL ASSEMBLY AND METHOD FOR DETECTING THE ROTATIONAL ANGLE THEREOF

(75) Inventors: Mark W. Lehnert, Rochester Hills, MI (US); John M. Schiappacasse, Farmington Hills, MI (US)

(73) Assignee: Stanley Black & Decker, Inc., New Britain, CT (US)

( * ) Notice: Subject to any disclaimer, the term of this patent is extended or adjusted under 35 U.S.C. 154(b) by 126 days.

(21) Appl. No.: 12/405,969

(22) Filed: Mar. 17, 2009

(65) Prior Publication Data

US 2009/0255700 A1 Oct. 15, 2009

Related U.S. Application Data

(60) Provisional application No. 61/037,148, filed on Mar. 17, 2008.

(51) Int. Cl.
*B25B 23/14* (2006.01)

(52) U.S. Cl. ..... 173/1; 173/2; 173/176; 173/183; 73/862.23

(58) Field of Classification Search ..... 173/1, 176, 173/183, 935, 93.6, 181, 182, 2, 93.5; 73/862.23
See application file for complete search history.

(56) References Cited

U.S. PATENT DOCUMENTS

| | | | | |
|---|---|---|---|---|
| 5,105,519 | A | 4/1992 | Doniwa | |
| 5,315,501 | A * | 5/1994 | Whitehouse | 700/32 |
| 5,366,026 | A * | 11/1994 | Maruyama et al. | 173/180 |
| 5,439,063 | A * | 8/1995 | Anders et al. | 173/177 |
| 5,457,866 | A * | 10/1995 | Noda | 29/407.02 |
| 5,637,968 | A * | 6/1997 | Kainec et al. | 318/432 |
| 6,341,533 | B1 * | 1/2002 | Schoeps | 73/862.23 |
| 6,516,896 | B1 * | 2/2003 | Bookshar et al. | 173/1 |
| 6,765,357 | B2 * | 7/2004 | Cripe et al. | 318/114 |
| 6,868,742 | B2 * | 3/2005 | Schoeps | 73/862.21 |
| 7,089,080 | B1 * | 8/2006 | Lysaght | 700/160 |
| 7,424,919 | B2 * | 9/2008 | Friberg | 173/1 |
| 7,467,669 | B2 * | 12/2008 | Friberg et al. | 173/1 |

FOREIGN PATENT DOCUMENTS

| | | |
|---|---|---|
| DE | 3324333 A1 | 1/1985 |
| DE | 4429282 A1 | 2/1996 |
| WO | WO2005/063448 | 7/2005 |
| WO | WO2005/095061 | 10/2005 |

OTHER PUBLICATIONS

Search Report and Written Opinion as issued for PCT Appln. No. PCT/US2009/037417, dated Jun. 12, 2009.
International Preliminary Report on Patentability as issued for PCT Appln. No. PCT/US2009/037417, dated Sep. 30, 2010.

* cited by examiner

*Primary Examiner* — Scott A. Smith
(74) *Attorney, Agent, or Firm* — Pillsbury Winthrop Shaw Pittman LLP

(57) ABSTRACT

A discontinuous drive power tool assembly for generating rotational torque includes a spindle having a first end portion and a second end portion. The first end portion of the spindle is configured to engage and rotate an object. The tool assembly also includes a pulse hammer selectively engagable with the second end portion of the spindle, and a motor that includes a motor shaft engagable with the pulse hammer. The motor is configured to rotate the pulse hammer. The tool assembly also includes a rotational position sensor disposed adjacent the motor. The rotational position sensor is configured to measure the rotational position of a second portion of the motor shaft which is opposite the first end portion of the motor shaft during operation of the tool assembly.

13 Claims, 6 Drawing Sheets

DISCONTINUOUS DRIVE TOOL ASSEMBLY AND METHOD FOR DETECTING THE ROTATIONAL ANGLE THEREOF

CROSS-REFERENCE TO RELATED APPLICATIONS

This application claims the benefit of priority from U.S. Provisional Patent Application Ser. No. 61/037,148, filed Mar. 17, 2008, the entire content of which is incorporated herein by reference.

FIELD

The present invention is generally related to a discontinuous drive tool assembly, and to a discontinuous drive torque tool assembly, including impact and impulse tool assemblies, having rotational angle detection.

BACKGROUND

Discontinuous drive tools are used to provide an amount of torque to an item, such as a bolt or a nut that is being tightened to another object. It is difficult when using these tools to identify when a bolt is properly secured to the item to which it is being tightened. The more common method for determining proper securing is to use a measurement of torque. In securing threaded fasteners, it is also common practice to specify a two-stage process by which to tighten the fastener. In the first stage, a torque level is measured and it is determined whether the measured torque value has passed a threshold torque level at which it can be determined that the threaded components are secured to a snug level. In the second stage, a final angle of fastener rotation beyond the threshold torque level is specified to produce the desired clamping force. The angle of rotation limits may also be specified to determine whether a fastener tightened to a final torque level was within the limits for determination of such conditions as cross-threading, rehit of a pre-tightened fastener, incorrect components in the assembly (or out of specification components) and stripped threads. Using the two stage process prevents errors or mistakes from occurring and can be used to preload the fastener to a specified level. The difficulty exists when using a power tool such as a discontinuous drive tool as to when the threshold torque is reached and at what time the fastener has moved through the specified angle after the threshold has been met.

SUMMARY

According to an aspect of the present invention, there is provided a discontinuous drive power tool assembly for generating rotational torque. The discontinuous drive power tool assembly includes a spindle having a first end portion and a second end portion. The first end portion of the spindle is configured to engage and rotate an object. The tool assembly also includes a pulse hammer selectively engagable with the second end portion of the spindle, and a motor that includes a motor shaft engagable with the pulse hammer. The motor is configured to rotate the pulse hammer. The tool assembly also includes a rotational position sensor disposed adjacent the motor. The rotational position sensor is configured to measure the rotational position of a second portion of the motor shaft which is opposite the first end portion of the motor shaft during operation of the tool assembly.

According to an aspect of the present invention, there is provided a sensing system for sensing a rotational position of a motor shaft of a discontinuous drive power tool assembly during operation of the tool assembly. The sensing system includes a rotational position sensor disposed adjacent a rear end portion of the motor shaft. The rotational position sensor is configured to measure the rotational position of the rear end portion of the motor shaft during operation of the tool assembly. The rotational position sensor includes a magnet configured to be mounted to the rear end portion of the motor shaft and an integrated circuit constructed and arranged to detect a rotational position of the magnet relative to a longitudinal axis of the motor shaft during operation of the tool assembly. The sensing system also includes a torque sensor configured to identify a moment in time when the tool assembly is delivering a peak torque pulse to an object worked on by the tool assembly. The torque sensor is operatively connected to the integrated circuit so that the integrated circuit records the rotational position of the magnet at the time of the peak torque pulse.

According to an aspect of the present invention, there is provided a method for measuring angular displacement of an object rotated by a discontinuous drive power tool assembly. The method includes sensing rotation of a shaft of a motor, identifying a moment event when the shaft of the motor ceases or slows rotation concurrently with delivery of a peak torque pulse by the discontinuous drive power tool assembly, and measuring a first rotational reference angle position related to the angular displacement of the shaft of the motor when the moment event occurs. The method also includes rotating the motor shaft a predetermined amount, identifying a subsequent moment event when an output shaft of the discontinuous drive power tool assembly delivers a torque pulse, and measuring a subsequent rotational angle position related to the angular displacement of the shaft of the motor when the subsequent moment event occurs.

BRIEF DESCRIPTION OF THE DRAWINGS

Features of embodiments of the present invention are illustrated in the drawings, in which like reference numerals designate like element. The drawings form part of the original disclosure, in which.

DETAILED DESCRIPTION

Figure 1:
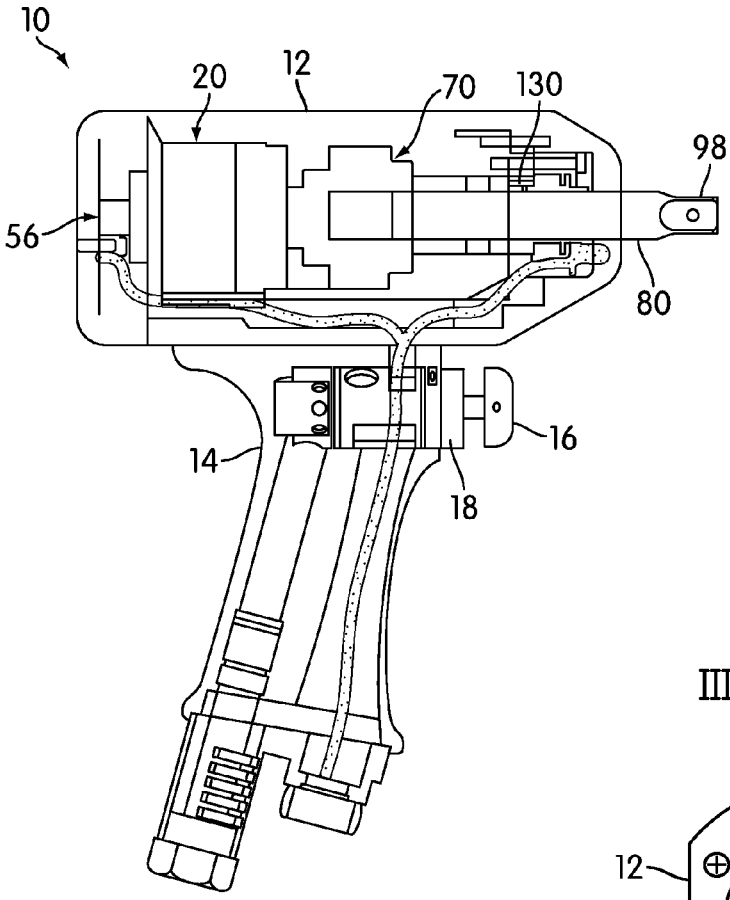
FIG. 1 is a side view of a discontinuous drive power tool according to an embodiment of the present invention.
Figure 2:
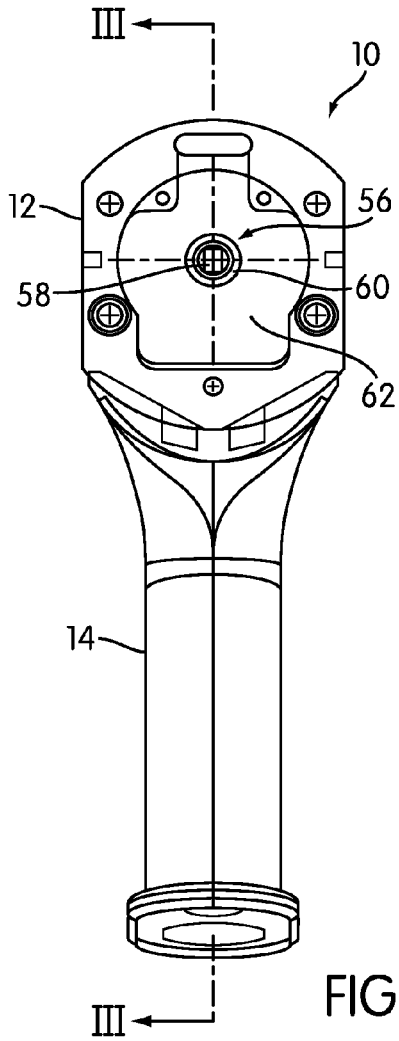
FIG. 2 is a rear view of the discontinuous drive power tool of FIG. 1.
Figure 3:
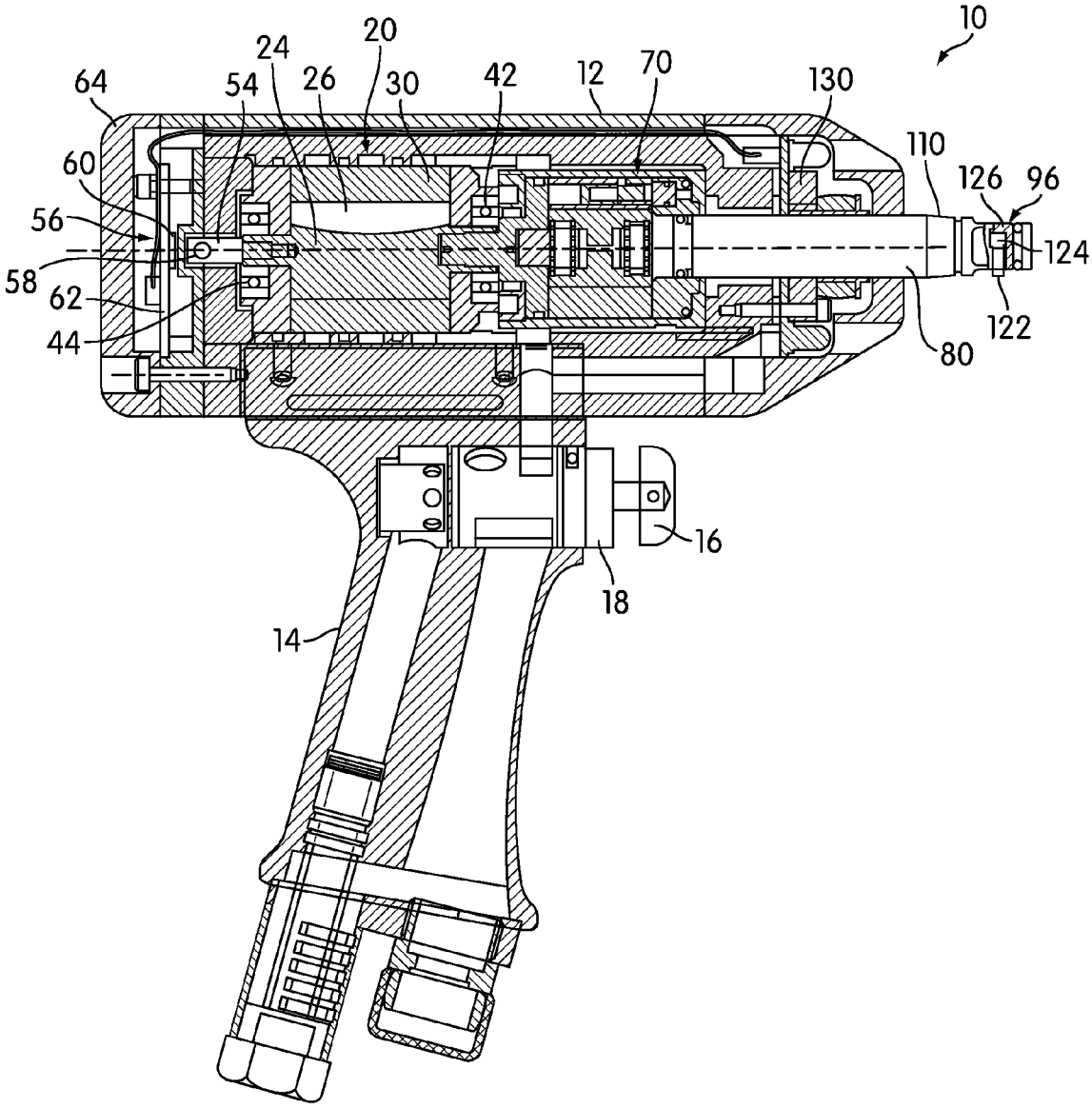
FIG. 3 is a cross-sectional view of the tool of FIG. 2 taken along line III-III.

FIGS. 1-3 illustrate a discontinuous drive power tool 10 according to an embodiment of the present invention. The illustrated tool 10 is of a pneumatic type that is configured to be powered by a compressed gas, such as compressed air. Although a pneumatic tool is illustrated, it is understood that embodiments of the present invention described herein may be used in discontinuous drive power tools that are of the hydraulic or electric type, including battery-powered type, as well. The discontinuous drive power tool 10 is a hand held device that includes a housing 12 and a handle 14 that is connected to the housing 12. The handle 14 is configured to be grasped by an operator's hand. In the illustrated embodiment, the handle 14 and the housing 12 are in a configuration that resembles a pistol, although it will be appreciated by one of ordinary skill in the art that the discontinuous drive power tool 10 may include a configuration other than the one illustrated in FIGS. 1-3.

The discontinuous drive power tool 10 also includes a trigger 16 that is mounted in the handle 14 and allows the operator to selectively turn the discontinuous drive power tool 10 on and off, as desired. A reversing lever 18 may be provided on the trigger 16. The reversing lever 18 allows the operator to tighten or loosen the object being worked on by the discontinuous drive power tool 10.

The discontinuous drive power tool 10 also includes a motor subassembly 20, an embodiment of which is shown in greater detail in FIG. 4 and discussed in further detail below, and a pulse hammer or impact converter subassembly 70, an embodiment of which is shown in greater detail in FIG. 5 and discussed in further detail below. The motor subassembly 20 and the impact converter subassembly 50 are generally located within a housing 12, as shown in FIG. 3.

Figure 4:
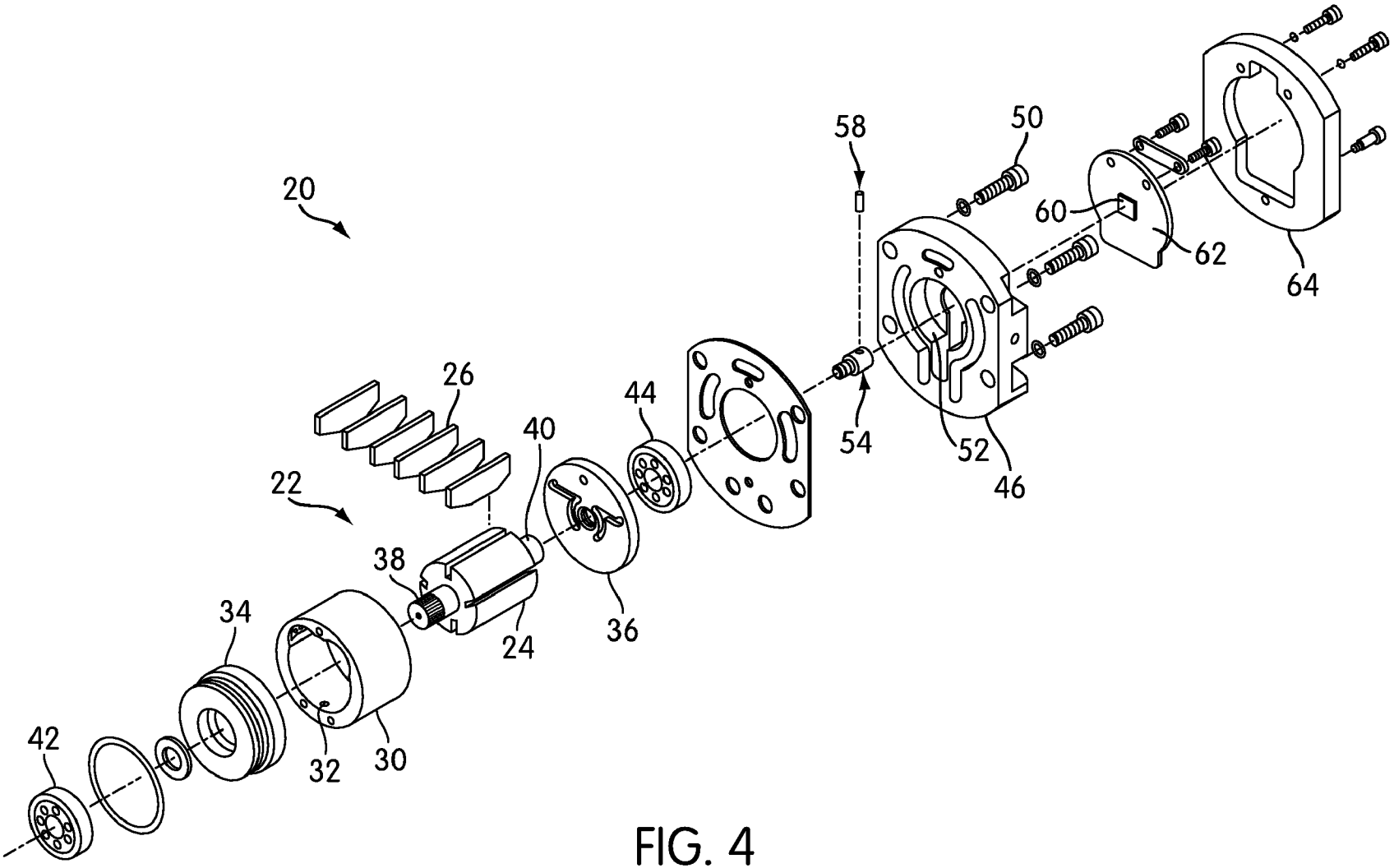
FIG. 4 is an exploded perspective view of a motor subassembly of the discontinuous drive power tool of FIG. 1.

As illustrated in FIG. 4, the motor subassembly 20 includes a motor 22 that includes a rotor shaft 24, which may alternatively be referred to as a motor shaft, a plurality of blades or vanes 26 that are connected to the rotor shaft 24, and a housing 30 that receives the rotor shaft 24 and the blades 26. The housing 30 includes an opening 32 through which a compressed gas may enter, once the rigger 16 is actuated by the operator, as discussed in further detail below. A front cap 34 may be connected to a front end of the housing 30 and a rear cap 36 may be connected to a rear end of the housing 30 to define a space for the rotor shaft 24 and blades 26 to rotate. The front cap 34 and the rear cap 36 each includes a central opening that is configured to allow a distal 38 and proximal 40 portion of the rotor shaft 24 to extend therethrough.

A front bearing 42 may be press fit onto the distal portion 38 of the rotor shaft 24 and a rear bearing 44 may be press fit onto the proximal portion 40 of the rotor shaft 24. The front and rear bearings 42, 44 may be mounted within the housing 12 by known methods so as to secure the motor 22 to the housing 12, yet allow the rotor shaft 24 to freely rotate within the housing 30. Various seals, o-rings, and gaskets may be used to seal the motor 22 so that compressed air that is delivered to the motor housing 30 via the opening 32 does not leak out of the motor 22 and into the rest of the housing 12. A cap 46 may be connected to a rear end 48 of the housing 12 with a plurality of fasteners 50. In the embodiment illustrated in FIG. 3, the cap 46 includes a cut-out portion 52 that is configured to receive the rear bearing 44.

A standoff spacer 54 may be connected to the proximal portion 40 of the rotor shaft 24. The standoff spacer 54 may be formed integrally with the rotor shaft 24 or may be a separate piece that is connected to the rotor shaft 24 via a threaded or welded connection.

Figure 6:
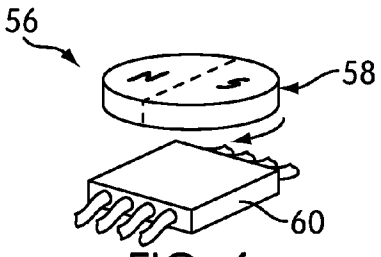
FIG. 6 is a schematic view of a rotational position sensor of the tool of FIG. 1.

As illustrated in FIGS. 3 and 4, a rotational position sensor 56 is provided at the rear end of the tool. The rotational position sensor includes a dual pole magnet 58 that is carried by the standoff spacer 54. The rotational position sensor 56 also includes an integrated circuit 60 that is mounted on a microprocessor 62. The microprocessor 62 is mounted to the cap 46 so that the integrated circuit 60 is located near the proximal end of the standoff spacer 54, as schematically illustrated in FIG. 4. This allows the integrated circuit 60 to measure the magnetic flux density of the magnet 58, to identify when the magnet 58 is rotating and when the magnet 58 is stationary, and to ultimately measure the angular orientation or position of the magnet 58 and therefore the rotor shaft 24. An example of such a rotational position sensor 56 is produced by Melexis and can be found on the internet at www.melexis.com. A more detailed schematic view of the rotational position sensor 56, including the magnet 58 having north N and south S poles, and the integrated circuit 60 is shown in FIG. 6. Returning to FIGS. 3 and 4, an additional rear cap 64 may be attached to the cap 46 with a plurality of fasteners 66 to provide protection to the microprocessor 62.

Figure 5:
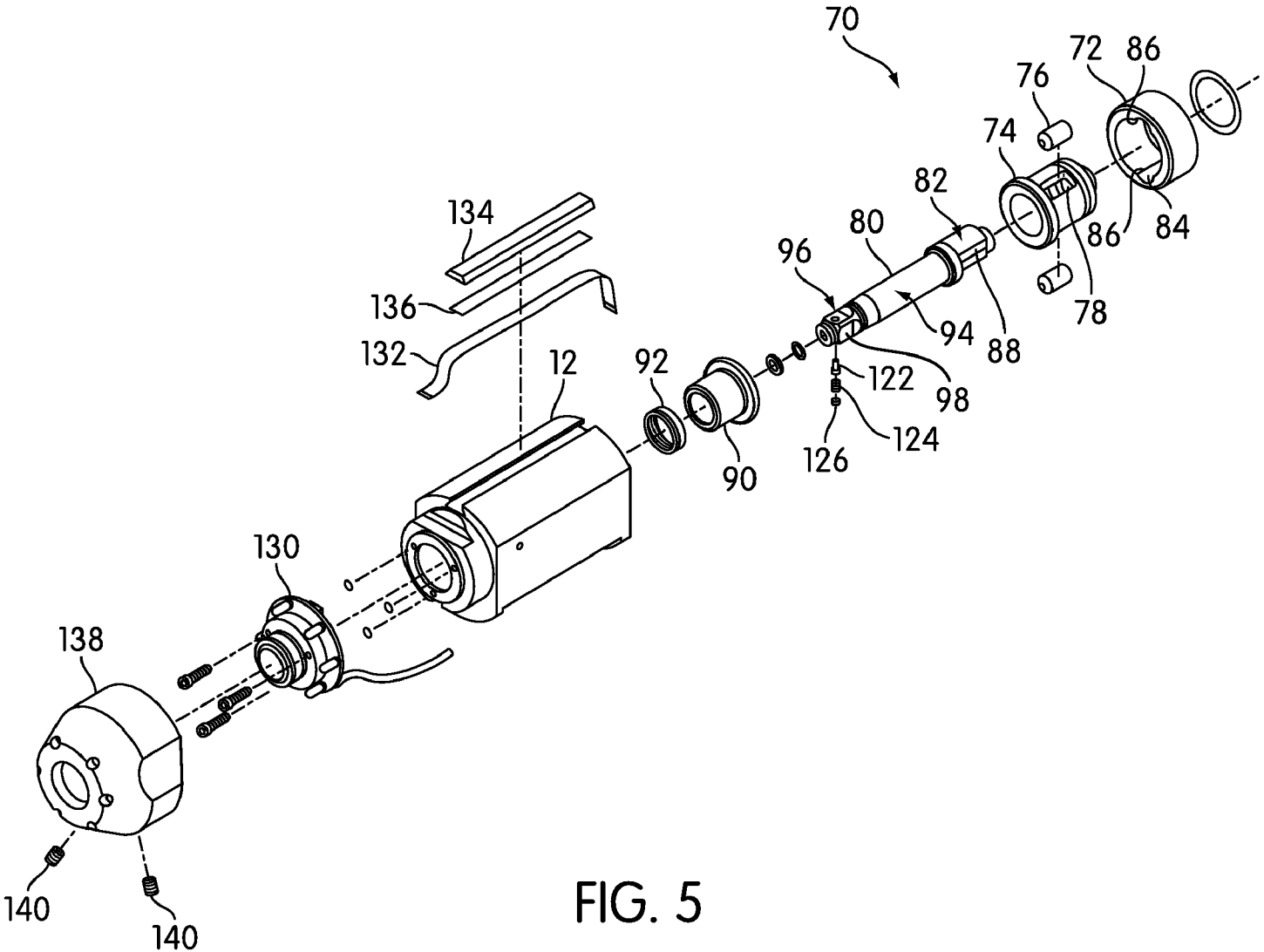
FIG. 5 is an exploded perspective view of a pulse hammer subassembly of the discontinuous drive power tool of FIG. 1.

FIG. 5 illustrates the pulse hammer or impact converter subassembly 70 in further detail. As illustrated, the subassembly 70 includes a pulse hammer or impact converter 72, a coupler or pulse roller cage 74 that is configured to received a plurality of rollers 76 via openings 78 in the coupler 74, and a spindle 80 that has a proximal portion 82 that is configured to be received by the coupler 74. The coupler 74 and rollers 76 are configured to be inserted into the pulse hammer 72 and rotate within and interact with the pulse hammer 72, as is known in the art. See for example, U.S. Pat. No. 4,347,902, which is incorporated herein by reference.

In an embodiment, the pulse hammer 72 includes a plurality of recesses 84 that define cam surfaces 86 that are configured to interact with the rollers 76. The coupler 74 is operatively connected to the rotor shaft 24 so that the coupler 74 rotates with the rotor shaft 24. The proximal portion 82 of the spindle 80 includes cam surfaces 88 that interact with the rollers 76. The cam surfaces 86 of the pulse hammer 72, the cam surfaces 88 of the spindle 80, and the rollers 76 are configured to allow the pulse hammer 72 to momentarily freely rotate and accelerate, relative to the rotational speed of the coupler 74 and the rotor shaft 24, to build up and store energy in the pulse hammer 72. When the rollers 76 are forced inward with respect to the coupler 74 by the cam surfaces 86 of the pulse hammer 72, the rollers 76 engage the spindle 80 and the stored energy in the pulse hammer will transfer to the spindle 80, thereby creating an impact blow to the spindle 80, which is transferred to the object being worked on, such as a fastener being tightened, by the tool 10. After the impact blow has been delivered, the pulse hammer 72 will decelerate, the spindle 80 will disengage from the coupler 74 so that the spindle does not rotate as the rotor shaft 24 continues to rotate, and the cycle may start over again with acceleration of the pulse hammer 72.

Figure 7:
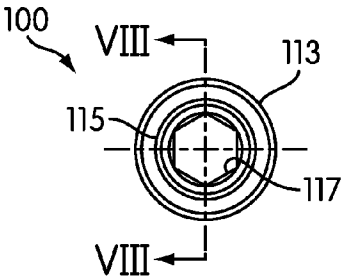
FIG. 7 is a distal end view of a socket that may be connected to the discontinuous drive power tool of FIG. 1.
Figure 8:
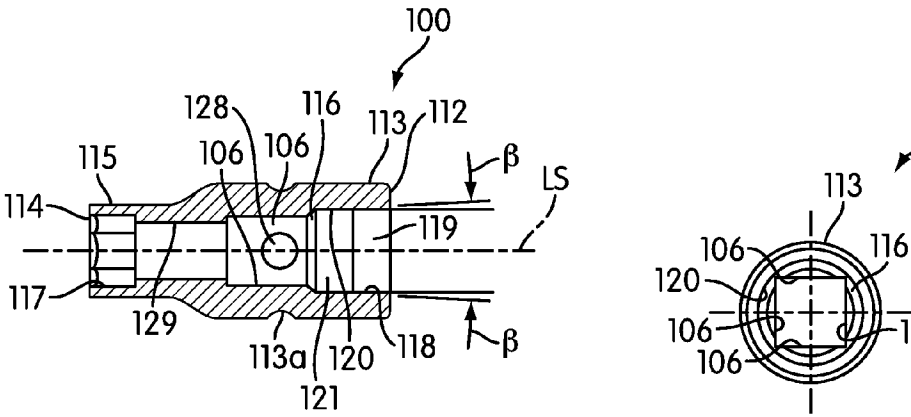
FIG. 8 is a cross sectional view of the socket of FIG. 7 taken along line VIII-VIII.
Figure 9:
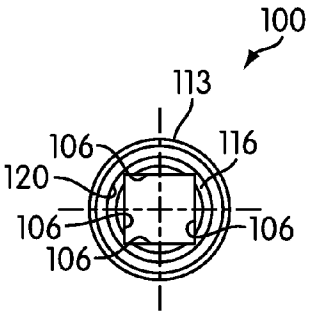
FIG. 9 is a proximal end view of the socket of FIGS. 7 and 8.

The spindle 80 may be further supported by the housing 12 via a bushing 90, and an oil seal 92 may be used to seal the pulse hammer subassembly 70 from the rest of the discontinuous drive power tool 10. A central portion 94 of the spindle 80 has a generally cylindrical shape and a circular cross section. A distal portion 96 of the spindle 80, includes a male spindle end 98 having a portion with a substantially rectangular section shape and square cross section. The male spindle end 98 is configured to receive, for example, a socket tool or power socket 100, an embodiment of which is illustrated in FIGS. 7-9.

Figure 11:
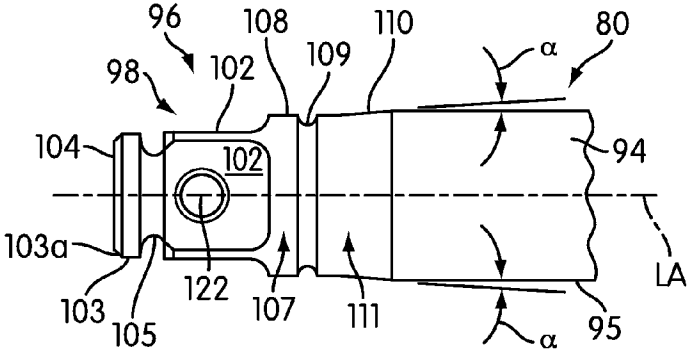
FIG. 11 is a detailed side view of a distal end portion of the spindle of FIG. 10.
Figure 10:
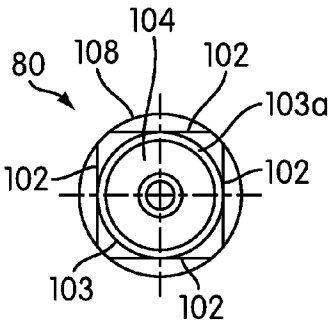
FIG. 10 is a distal end view of a spindle of the discontinuous drive power tool of FIG. 1.

As illustrated in greater detail in FIGS. 10 and 11, the male spindle end 98 includes a primary engagement surface 102 that is disposed near a distal end 104 of the spindle 80 and is configured to engage a primary engagement surface 106 of the socket 100. The primary engagement surfaces 102, 106 are configured to allow the spindle 80 to transfer the impact force produced by the pulse hammer 72, as described above, to the socket 100 and ultimately to the object being worked on. A cylindrical surface 103 defining a cylinder is disposed adjacent the distal end 104 of the spindle 80 and a recess or groove 105 is disposed in between the cylindrical surface 103 and the primary engagement surface 102. As illustrated, the recess 105 is defined by a concave surface. A small chamfer 103 a defining a tapered, conical surface may be located between the cylindrical surface 103 and the distal end 104.

Moving towards the central portion 94 of the spindle 80 and away from the distal end 104, a cylindrical surface 108 that defines a cylindrical portion 107 is disposed adjacent the primary engaging surface 102. A tapered surface 110 is separated from the cylindrical surface 108 by a recess or groove 109, which is defined by a concave surface, and extends towards the central portion 94 of the spindle 80, which has a cylindrical surface 95. The tapered surface 110 defines a conical portion 111 of the spindle 80. In the illustrated embodiment, the diameter of the conical portion 111 that is adjacent the recess 109 is substantially the same as the diameter of the cylindrical portion 107, and the diameter of the conical portion 111 that is adjacent the central portion 94 is substantially the same as the diameter of the central portion 94. Other diameters may be used. The illustrated embodiment is not intended to be limiting in any way.

In the illustrated embodiment, the tapered surface 110 extends along the spindle 80 by a length that is less than a length of the primary engagement surface 102. In an embodiment, the tapered surface 110 may define an angle $\alpha$ of up to about 45° relative to a longitudinal axis LA of the spindle 80 to concentrically locate the socket 100 relative to the spindle 80. In an embodiment, the tapered surface 110 may define an angle $\alpha$ between about 1° and about 16° relative to the longitudinal axis LA for locking purposes, as discussed in further detail below, and in an embodiment, the tapered surface 110 may define an angle $\alpha$ of about 7° relative to the longitudinal axis LA.

The socket 100 is adapted to be secured to the distal portion 96 of the spindle 80 and includes a spindle receiving end 112, or proximal end or female drive end, that is generally cylindrical in shape and is defined by an outer cylindrical surface 113. The outer cylindrical surface 113 may include a recess or groove 113 a that is defined by a concave surface that extends around the entire circumference of the socket 100. The socket 100 also includes an object receiving end 114, or distal end, that is also generally cylindrical in shape and is defined by an outer cylindrical surface 115. In the illustrated embodiment, the outer cylindrical surfaces 113, 115 do not have the same diameter, but in other embodiments, the outer cylindrical surfaces 113, 115 may have the same diameter or the outer cylindrical surface 115 may have a diameter that is greater than the diameter of the outer cylindrical surface 113. The object receiving end 114 includes an opening that is defined by an object engaging surface 117 that is configured to engage the object being worked on by the discontinuous drive power tool 10, such as a nut or a bolt. In an embodiment, the object engaging surface 117 defines a hexagonal shape, such as the shape of a hexagonal head of a bolt or the shape of a hexagonal nut. The particular shape of the object engaging surface 117 is desirably suitable for the shape of the object being driven with the discontinuous drive power tool 10, as is know in the art.

The spindle receiving end 112 of the socket 100 typically has an outside diameter that is greater than the diameter of the central portion 94 of the spindle 80. The spindle receiving end 112 includes an opening that extends into the socket 100 and is at least partially defined by a tapered surface 118 that defines a conical tapered portion 119 that is configured to receive the tapered surface 110 and conical tapered portion 111 of the spindle 80. The tapered surface 118 of the socket 100 has an angle $\beta$ relative to a longitudinal axis LS of the socket 100 that is desirably the same or about the same as the angle $\alpha$ of the tapered surface 110 of the spindle 80 to concentrically locate the socket 100 relative to the spindle 80. For example, the angle $\beta$ may be up to about 45° relative to the longitudinal axis LS of the socket 100. In an embodiment, the tapered surface 118 may define an angle $\beta$ between about 1° and about 16° relative to the longitudinal axis LS for locking purposes, and in an embodiment, the tapered surface 118 may define an angle $\beta$ of about 7° relative to the longitudinal axis LS.

In embodiments in which the angle $\alpha$ of the tapered surface 110 of the spindle 80 is the same or substantially the same as the angle $\beta$ of the tapered surface 118 of the socket 100, the two tapered surfaces 110, 118 will create a locking structure when they are placed in contact with each other.

The opening of the spindle receiving end 112 may be further defined by the primary engagement surface 106 that is configured to receive the primary engagement surface 102 of the spindle 80. The primary engagement surface 106 of the socket 100 is generally rectangular or square and is square in cross section and has a periphery that is substantially identical to the periphery of the primary engagement surface 102 of the spindle 80. In the illustrated embodiment, the socket 100 also includes an intermediate surface 120 that is in between the tapered surface 118 and the primary engagement surface 106. The intermediate surface 120 is cylindrical in shape and defines a cylindrical portion 121. The intermediate surface 120 provides a transition between the tapered surface 118 and the primary engagement surface 106. As illustrated, a chamfer 116 having a tapered, conical surface may be located in between the intermediate surface 120 and the primary engagement surface 106. In an embodiment, not illustrated, the socket 100 may not include the intermediate surface and the tapered surface 118 may be configured so that the primary engagement surface 106 extends from the tapered surface 118. The socket 100 may also include a cylindrical surface 129 that extends in between the primary engaging surface 106 and the object engaging surface 117. In an embodiment, illustrated in FIG. 12, the socket 100 may not include the cylindrical surface 129 and may not have an opening through the entire length of the socket 100. The illustrated embodiments are not intended to be limiting in any way.

The engagement of the tapered surface 118 of the socket 100 and the tapered surface 110 of the spindle 80 substantially prevents lost motion between the spindle 80 and the socket 100, which may reduce wear on the socket 100 and allow for more accurate transmission of forces and torque from the tool 10 to the socket 100 and object being worked on. In addition, the tapered surfaces 110, 118 may assist in aligning the primary engagement surface 102 of the spindle 80 with the primary engagement surface 106 of the socket 100.

Figure 12:
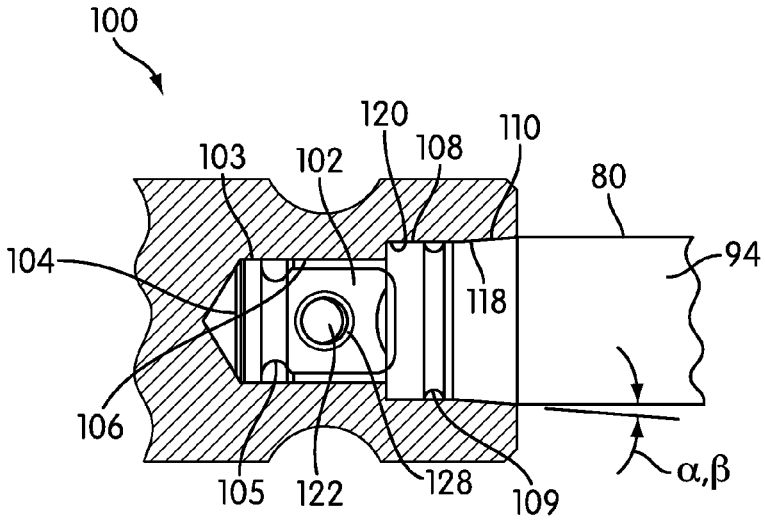
FIG. 12 is a detailed view of the socket of FIG. 8 connected to the spindle of FIG. 11.

As illustrated in FIGS. 3 and 5, the male spindle end 98 may include a pin 122 or ball that is biased outwardly from a center of the male spindle end 98 with a spring 124 that is held in place by a plug 126, as is known in the art. A recess 128 that is configured to received a distal end of the pin 122 may be provided in the primary engagement surface 106 of the socket 100 (see FIG. 8) at a location that corresponds to the location of the pin 122 relative to the primary engagement surface 102 of the spindle 80. As the primary engagement surface 102 of the spindle 80 engages the primary engagement surface 106 of the socket 100 and is advanced therealong, the pin 122 will be pressed against the bias of the spring 124 and retract into the spindle 80 until the pin 122 is located at the recess 128 in the socket 100. Once the pin 122 is located at the recess 128 in the socket 100, which should correspond to the same position of the spindle 80 relative to the socket 100 in which the tapered surfaces 110, 118 are fully engaged and locked together, the spring 124 will bias the pin 122 outward from the spindle 80 once again, thereby providing an additional structure to lock the socket 100 to the spindle 80, as illustrated in FIG. 12.

Returning to FIG. 3, the tool 10 also includes a torque sensor 130 that is constructed and arranged to measure the amount of torque being delivered by the spindle 80 to the object being worked on. As illustrated, the torque sensor 130 may be provided at the front end of the housing 12. Torques sensors are known in the art and therefore details of the torque sensor 130 will not be described herein. The torque sensor 130 may be operatively connected to the rotational position sensor 56 that is located at the rear end of the tool 10 via a signal passageway 132, which may be in the form of a ribbon cable. The cable 132 may be run along the length of the housing 12 on the outside of the housing 12 and a cover 134 may be used to cover the cable 132. To ensure that the cover stays in place, a piece of two-sided tape 136, or any other adhesive or suitable fastener, may be placed between the cable 132 and the cover 134. A separate cover 138 may be used to cover the torque sensor 130 and may be secured to the housing 12 via suitable fasteners 140, such as set screws.

Figure 13:
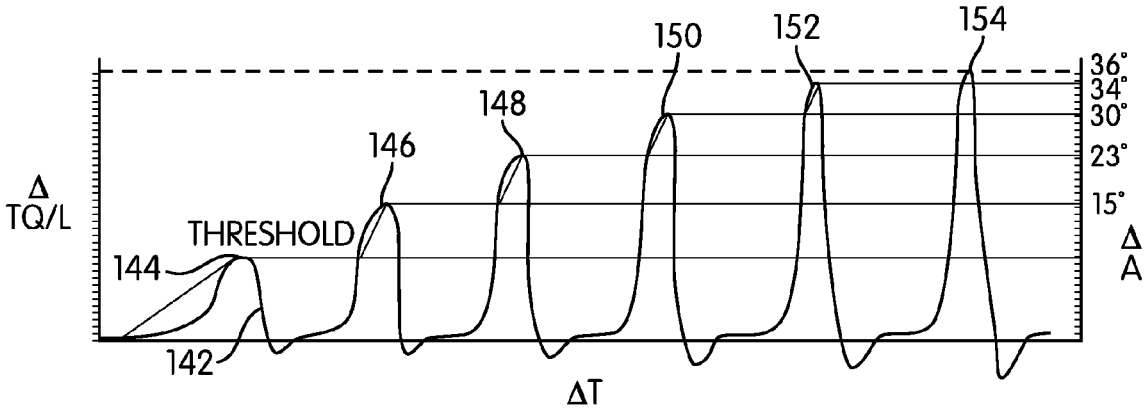
FIG. 13 is a graph representing angle and torque as a function of time based on a method using the invention.

The torque sensor 130 may be configured to provide a continuous torque measurement as a function of time, as illustrated by curve 142 in FIG. 13, and communicate the torque measurement to the microprocessor 62 via the cable 132. In an embodiment, the torque sensor 130 is configured to identify a moment in time when the tool 10 is delivering a peak torque pulse to the object being worked on, as represented by threshold 144 in FIG. 13, and to send a signal to the integrated circuit 60 of the rotational position sensor 56 to trigger a reading of the rotational position of the magnet 58, and hence the rotor shaft 24. The initial reading may be treated as a reference rotational angular position that is concurrent with the threshold torque level moment event. The microprocessor 62 records the reading from the integrated circuit 60. When the torque sensor 130 identifies the next moment in time when the tool 10 is delivering a peak torque pulse to the object being worked on, as represented by peak 146 in FIG. 13, the torque sensor 130 sends another signal to the integrated circuit 60 of the rotational position sensor 56 to trigger a subsequent reading of the rotational angular position of the magnet 58 and the rotor shaft 24. The difference between the rotational angular position from the subsequent reading and the reference rotational angular position provides an indication of how much the object being worked on (e.g., fastener) has been rotated. For example, if the reference rotational angular position is 90° and the rotational angular position from the subsequent reading is 97°, the microprocessor 62 can calculate that the fastener has been rotated 7° during an impact event, assuming the rotor shaft 24 rotated 360° (or a multiple of 360°) during the time when the rotor shaft 24 was disengaged from the spindle 80. The microprocessor 62 should be programmed to take into account the rotation of the rotor shaft 24 when it is disconnected from the spindle 80, particularly if the rotor shaft 24 rotates less than 360° or more than 360° (and not a multiple of 360°).

Similarly, when the torque sensor 130 identifies the next moment in time when the tool 10 is delivering a peak torque pulse to the object being worked on, as indicated by the next peak 148, the torque sensor 130 sends another signal to the integrated circuit 60 of the rotational position sensor 56 to trigger another subsequent reading of the rotational angular position of the magnet 58. This allows the microprocessor 62 to provide an indication to the operator of the tool 10 how much the object being worked on has rotated since the tool 10 started working on the object (i.e., tightening a fastener), as shown on the right hand axis of FIG. 13. This process may continue (see peaks 150, 152, 154 in FIG. 13) until the operator is finished working on the object (tightening the fastener) with the discontinuous drive power tool 10.

To operate the discontinuous drive power tool 10 in accordance with embodiments of the present invention, the socket 100 having a suitable design that corresponds to the object to be worked on, such as a fastener (i.e., bolt) or a nut, may be secured to the male spindle end 98, and the handle 14 of the discontinuous drive power tool 10 may be connected to a source of compressed air. The operator may then engage the object to be worked on with the socket 100 and actuate the trigger 16 to begin to tighten the object relative to a workpiece it is being fastened to. Actuating the trigger 16 allows the compressed air to enter the motor housing 30 via the opening 32, which causes the rotor shaft 24 to rotate.

The rotor shaft 24 of the motor 22 is engaged with the pulse hammer 72 and coupler 74 and causes the pulse hammer 72 to accelerate and provide an impact torque to the spindle 80, which is transferred to the socket 100 and ultimately to the object being worked on, as discussed above.

The angular displacement of the object being rotated by the discontinuous drive power tool 10 is measured by initially sensing the torque delivered through the spindle 80 to the object being rotated at the peak of each impact pulse provided by the pulse hammer 72 with the torque sensor 130. Once the torque level reaches or surpasses the threshold torque level 144, the rotational angular position of the rotor shaft 24 of the motor 22 is sensed and recorded as being at its absolute rotational angular position relative to the longitudinal axis LA by the integrated circuit 60 that is fixed in position in the housing 12. The use of the rotational position sensor 56 identifies the angular starting (or reference) position that is concurrent with the threshold torque level moment event 144. The moment event is defined as when a measured torque pulse at its peak level as delivered by the spindle 80 is sensed. The rotor shaft 24 is coupled to the spindle 80 via the pulse hammer 72 at moments when the pulse hammer 72 transfers the torque generated by the rotation of the rotor shaft 24 and the pulse hammer 72 to the spindle 80. The spindle 80 then transfers the force to the object being worked on by the discontinuous drive power tool 10.

Once the impact of the force is received by the object being worked on, the pulse hammer 72 disengages and allows the rotor shaft 24 to rotate a predetermined amount, e.g., one-half turn (180°), one full turn (360°), etc. After the rotor shaft 24 has rotated the predetermined amount, the pulse hammer 72 reengages and once again allows for the transfer of force that is generated by the motor 22 and pulse hammer 72 all the way to the spindle 80 and to the object being fastened or worked on by the discontinuous drive power tool 10.

The torque sensor 130 is configured to identify the moment event of when the rotor shaft 24 of the motor 22 ceases its rotation in concert with the spindle 80. The torque sensor 130 transfers this information to the rotational position sensor 56 at which point the rotational position sensor 56 measures the rotational angular reference position of the rotor shaft 24 of the motor 22. This rotational angular reference position, which corresponds to the threshold moment event, is stored in memory, which may be part of the integrated circuit 60, or may be part of the microprocessor 62. The rotor shaft 24 is allowed to disengage from the spindle 80 and rotate the predetermined amount (180°, 360°, etc.) before recoupling with the spindle 80 to deliver a torque pulse to the object being worked on by the discontinuous drive power tool 10.

When the second peak torque moment event 146 occurs, i.e., when the rotor shaft 24 and the spindle 80 cease to rotate again, the second peak torque is identified by the torque sensor 130 and the torque sensor 130 sends a peak torque trigger signal to the rotational position sensor 56. At this point in time, a first subsequent rotational angular position of the rotor shaft 24 is measured by the rotational position sensor 56 and is stored in the memory on the integrated circuit 60 or the microprocessor in much the same way the information relating to the rotational angle reference position was stored. The process may continue with subsequent steps of measuring the rotational angular position of the rotor shaft 24 with the rotational position sensor 56 at each moment the torque sensor 130 measures a peak torque event (represented by 148, 150, 152, 154 in FIG. 13), taking into account an amount the rotor shat 24 rotates when disengaged from the spindle 80. The difference between a second subsequent rotational angular position of the rotor shaft 24 and the first subsequent rotational angular position may be calculated to identify the amount of rotational displacement the object (e.g., fastener) has been rotated by the discontinuous drive power tool 10. The number of steps or moment events that are measured depends on how many are needed to reach a predetermined angle of rotation or are accumulated until the tool is stopped by any such other means as may be determined. In an embodiment, the microprocessor 62 may be configured to measure the changes in positions of the rotor shaft 24 during the different peak torque events, and then add the changes in positions together to calculate the total rotation of the object being worked on.

As discussed above, FIG. 13 illustrates an amount of torque 142 that is applied to an object being worked on by the discontinuous drive power tool 10 over time. Once a particular threshold is met, identified by plateau 144, the method of measuring the angular displacement described above is engaged. The rotor shaft 24, and hence motor 22, experiences a moment event at each torque peak 146, 148, 150, 152, 154, which represents a maximum torque delivered per rotation of the rotor shaft 24 that is coupled 1/1 through the pulse hammer 72 with the spindle 80. The rotational position sensor 56 identifies the rotational angular position of the rotor shaft 24 at each torque peak. The integrated circuit 60 keeps track of the angle readings, as represented by the right hand axis illustrated in FIG. 13, until the total angular displacement reaches the desired rotational displacement of the item being worked on or until the discontinuous drive power tool 10 is stopped by other means.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

It should be appreciated that in one embodiment, the drawings herein can be considered to be drawn to scale (e.g., in correct proportion). However, it should also be appreciated that other proportions of parts may be employed in other embodiments.

Furthermore, since numerous modifications and changes will readily occur to those of skill in the art, it is not desired to limit the invention to the exact construction and operation described herein. Accordingly, all suitable modifications and equivalents should be considered as falling within the spirit and scope of the invention.

What is claimed is:

1. A discontinuous drive power tool assembly for generating rotational torque, the tool assembly comprising:

a spindle having a first end portion and a second end portion, the first end portion being configured to engage and rotate an object;

a pulse hammer selectively engagable with the second end portion of the spindle;

a motor including a motor shaft having a first end portion engagable with the pulse hammer, the motor being configured to rotate the pulse hammer; and a rotational position sensor disposed adjacent the motor, the rotational position sensor being configured to measure the rotational position of a second end portion of the motor shaft which is opposite the first end portion of the motor shaft during operation of the tool assembly, wherein the rotational position sensor comprises a magnet mounted to the second end portion of the motor shaft and an integrated circuit constructed and arranged to detect a rotational position of the magnet relative to a longitudinal axis of the motor shaft.

2. A discontinuous drive power tool assembly according to claim 1, further comprising a torque sensor configured to identify a moment in time when the tool is delivering a peak torque pulse to the object, the torque sensor being operatively connected to the integrated circuit so that the integrated circuit records the rotational position of the magnet at the time of the peak torque pulse.

3. A discontinuous drive power tool assembly according to claim 2, wherein the integrated circuit is programmed to record a plurality of rotational positions of the magnet with each position corresponding to different moment in time, and to add the plurality of rotational positions of the magnet for an absolute rotational position of the magnet, the motor shaft, the spindle, and the object.

4. A discontinuous drive power tool assembly according to claim 1, further comprising a coupler configured to selectively couple the pulse hammer and the motor shaft to the spindle to deliver a torque pulse to the spindle.

5. A discontinuous drive power tool assembly according to claim 1, wherein the motor is configured to rotate the spindle via the pulse hammer.

6. A discontinuous drive power tool assembly according to claim 1, wherein the tool assembly is configured to be powered by at least a compressed gas.

7. A sensing system for sensing a rotational position of a motor shaft of a discontinuous drive power tool assembly during operation of the tool assembly, the sensing system comprising:

a rotational position sensor disposed adjacent a rear end portion of the motor shaft, the rotational position sensor being configured to measure the rotational position of rear end portion of the motor shaft during operation of the tool assembly, the rotational position sensor comprising a magnet configured to be mounted to the rear end portion of the motor shaft and an integrated circuit constructed and arranged to detect a rotational position of the magnet relative to a longitudinal axis of the motor shaft during operation of the tool assembly; and a torque sensor configured to identify a moment in time when the tool assembly is delivering a peak torque pulse to an object worked on by the tool assembly, the torque sensor being operatively connected to the integrated circuit so that the integrated circuit records the rotational position of the magnet at the time of the peak torque pulse.

8. A sensing system according to claim 7, wherein the integrated circuit is programmed to record a plurality of rotational positions of the magnet with each position corresponding to different moment in time, and to add the plurality of rotational positions of the magnet for an absolute rotational position of the magnet, the motor shaft, and the object.

9. A method for measuring angular displacement of an object rotated by a discontinuous drive power tool assembly, the method comprising:

sensing rotation of a shaft of a motor;

identifying a moment event when the shaft of the motor ceases or slows rotation concurrently with delivery of a peak torque pulse by the discontinuous drive power tool assembly;

measuring a first rotational reference angle position related to the angular displacement of the shaft of the motor when the moment event occurs;

rotating the motor shaft a predetermined amount;

identifying a subsequent moment event when an output shaft of the discontinuous drive power tool assembly delivers a torque pulse; and measuring a subsequent rotational angle position related to the angular displacement of the shaft of the motor when the subsequent moment event occurs.

10. A method according to claim 9, further comprising storing the first rotational reference angle position and storing the second rotational angle position.

11. A method according to claim 10, further comprising determining the rotational angular displacement between the first rotational angle position and the subsequent rotational angle position.

12. A method according to claim 9, wherein the moment event and the subsequent moment event are identified by a torque sensor.

13. A method according to claim 9, wherein the first rotational reference angle position and the subsequent rotational angle position are measured with a rotational position sensor.

* * * * *